US005291818A

United States Patent [19]

Bannasch

[11] Patent Number: 5,291,818

[45] Date of Patent: Mar. 8, 1994

[54] PROCESS FOR DEFENDING OBJECTS EMITTING AN INFRARED RADIATION, AND DROPPABLE BODIES TO CARRY OUT THE PROCESS

[75] Inventor: Heinz Bannasch, Schönau am Königsee, Fed. Rep. of Germany

[73] Assignee: Buck Werke GmbH & Co., Uberkingen, Fed. Rep. of Germany

[21] Appl. No.: 875,856

[22] Filed: Apr. 29, 1992

[30] Foreign Application Priority Data

May 10, 1991 [DE] Fed. Rep. of Germany ..... 4115384

[51] Int. Cl.[5] ..... F41H 11/02

[52] U.S. Cl. ..... 89/1.11; 89/36.01; 342/12

[58] Field of Search ..... 89/1.11, 36.01, 36.12; 102/334, 364, 505; 342/12, 53

[56] References Cited

U.S. PATENT DOCUMENTS 4,069,762 1/1978 Maury ..... 89/1.11
4,222,306 9/1980 Maury ..... 102/505

FOREIGN PATENT DOCUMENTS 240819 10/1987 European Pat. Off. .

*Primary Examiner*—Stephen C. Bentley
*Attorney, Agent, or Firm*—Watson, Cole, Grindle & Watson

[57] ABSTRACT

A process is provided for defending objects emitting an infrared radiation, in particular ships, against missiles, which are equipped with intelligent infrared seeker heads. Following location of the missile, adjacent the object a large area pyrotechnical perturbing radiation cloud, which releases high infrared radiation in a short period of time, which hashes the locking on and pursuit electronics of the seeker head, and subsequently releases a weak infrared radiation for a comparatively long period, is produced between the object and the missile. Immediately following the end of the high radiation phase of the perturbing radiation cloud, several fake target clouds are set up that then lead the missile step-by-step away from the object to be defended. The perturbing radiation clouds are produced by the droppable bodies, whose active masses comprise phosphorus flares and phosphorus pellets.

7 Claims, 3 Drawing Sheets

PROCESS FOR DEFENDING OBJECTS EMITTING AN INFRARED RADIATION, AND DROPPABLE BODIES TO CARRY OUT THE PROCESS

BACKGROUND OF THE INVENTION

This invention relates to a process for defending objects emitting an infrared radiation, in particular ships, against missiles, which are equipped with intelligent, in particular, scanning, imaging, correlating and/or spectral filtering infrared seeker heads, and droppable bodies to carry out the process.

It is well-known to defend water borne, land borne or airborne; objects emitting an infrared radiation, in particular ships but also airplanes and tanks, against missiles equipped with infrared seeker heads, in that upon detection of the approach of a missile one or more protechnic fake target clouds are launched in succession by means of droppable bodies in the air space adjacent the object, the clouds guiding the infrared seeker head of the missile from the object and towards themselves. For example, reference is made to European Patent No. 0 240 819 wherein droppable bodies generating fake targets are placed and ignited in such a manner at specified times in predetermineed spatial regions that the generated fake targets lie on a deflection curve at specified intervals in time and space and are to be steered towards in such a manner in succession by the missile that its flight path passes over in the deflection curve and finally in the direction of deflection.

The fake target clouds comprise burning phosphorus flares, such as plates or strips which are coated with red phosphorus and which are ejected from the droppable body at a predetermined height at the desired point and in so doing are ignited.

However, the goal of the latest development in infrared seeker heads is to make the seeker heads "intelligent" and thus to make them immune to conventional infrared fake targets, i.e., to design them in such a manner that they respond to the object signature, in particular the ship signature. The development is proceeding in different directions. Thus, for example, for the imaging "gated video - target seeker heads" an adaptive "tracking gate" is used, which can be adapted accurately to the size of the targeted ship by means of video processors and suitable algorithms. The viewing window of the seeker head can be reduced after locking on the ship size, with the result that fake target clouds, which are generated outside this adaptive window, thus above or next to the ship, remain ineffectrive.

For the "correlation trackers" a human operator usually locks on the target. After locking on the object, the seeker head then finds by means of comparison (cross correlation) of two successive images (stored reference image/actual image) its way unimpeded into the target, even if infrared fake target clouds are produced in the vicinity of the target.

Another method to eliminate false targets consists of a frequency analysis by means of the seeker head, which can distinguish between the radiation characteristics of the infrared radiators (for example ship engines) of the target that exhibit a comparatively low temperature and the radiation characteristics of a hot fake target cloud. Thus, in summary the known infrared fake target clouds are not in a position to defend an object against missiles equipped with intelligent seeker heads.

SUMMARY OF THE INVENTION

Therefore, the object of the present invention is to provide a process and droppable body with which it is possible to guide missiles equipped also with intelligent seeker heads away from the target. This problem is solved according to the process and the device according to the invention.

Thus, the invention proceeds from the basic premise that a deflection of intelligent seeker heads is possible only if the reception of the ship signature for the seeker head is significantly disturbed, thus—seen from the seeker head—the ship signature is continuously destroyed; thus the seeker head must begin to locate the target again. Not until this instant is it possible to effect a deflection by means of known infrared fake target clouds which are more attactive to the seeker head, thus permitting the seeker head to lock on the fake target clouds, of course under the prerequisite that at this instant the actual target is "covered" in such a manner that the seeker head does not lock on the actual target.

DETAILED DESCRIPTION OF THE INVENTION

Figure 1:
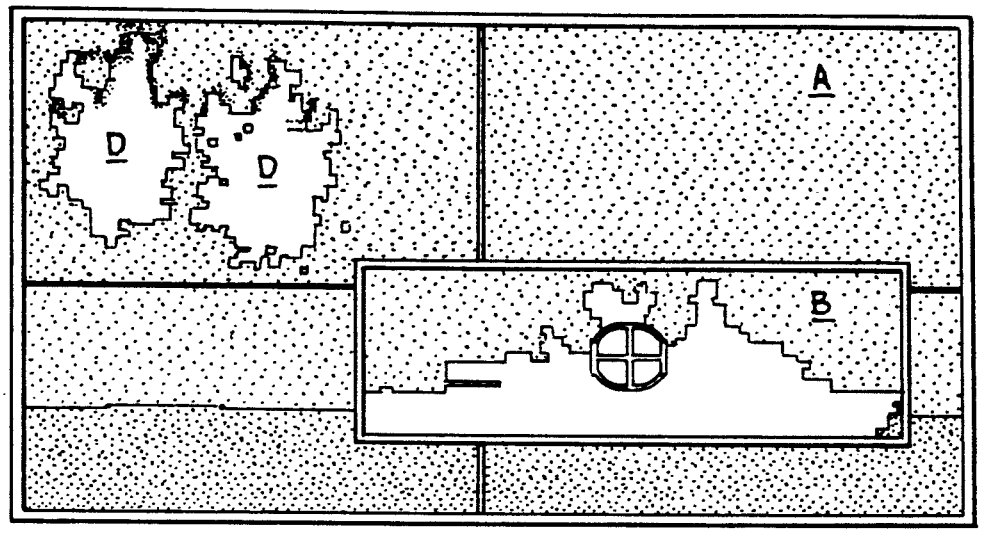
FIG. 1 is graphic view for explaining the ineffectiveness of customary infrared fake target clouds with respect to a seeker head with adaptive "tracking gate"

FIG. 1 shows the visual field A of an imaging infrared seeker head. The ship to be attacked is located in this visual field A. After locking the seeker head on the target (ship), the search field reduces to a window B, which corresponds to the size of the ship, and in particular with automatic adjustment irrespective of the distance between seeker head and ship. If at this stage the ship puts out, as customary in the past, fake target clouds on the side, as shown in the Figure, then such clouds remain apparently ineffective, because they are situated outside window B. If, however, the fake target clouds were to be set up within window B, thus at a point between ship and approaching missile, the missile would not be diverted from the ship, i.e., the missile would maintain its—intended—flight path.

Figure 2:
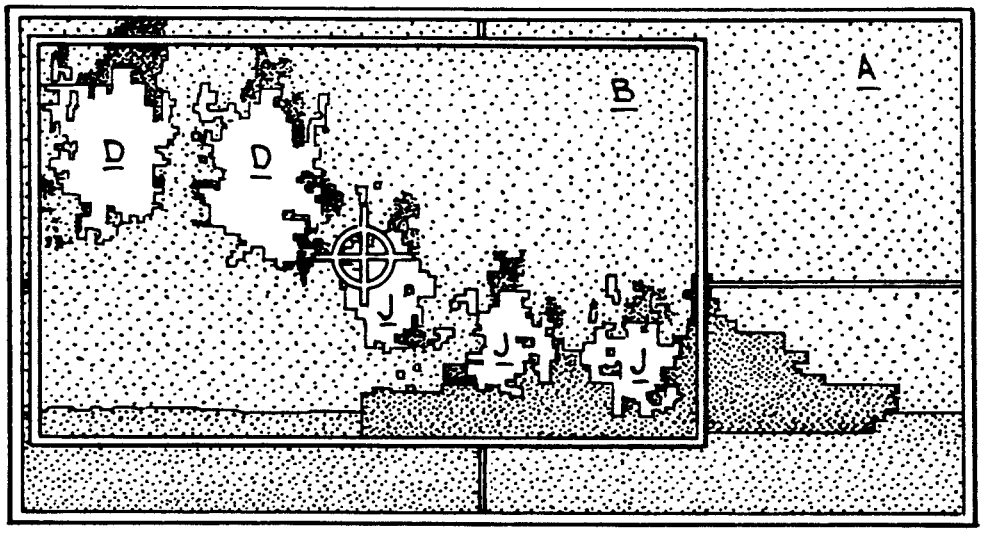
FIG. 2 is a graphic view similar to that of FIG. 1 for explaining the effectiveness of the process of the invention even for a seeker head with adaptive "tracking gate"

In contrast, one proceeds now in such a manner according to the invention that large area perturbing radiation clouds, which "wander" outwardly preferably in succession and that disturb, first of all, the reception of the ship signature and thus cause the seeker head to lose the target (FIG. 2), are produced between ship and approaching missile. The seeker head locks on the outwardly wandering radiation point of concentration; a renewed "detection of the ship signature" is prevented by the persisting camouflage effect of the perturbing radiation cloud. Through the use of conventional infrared fake target clouds D the seeker head can now be deflected step-by-step from the ship. The manner in which this deflection is accomplished in detail will be explained in the following.

Figure 3:
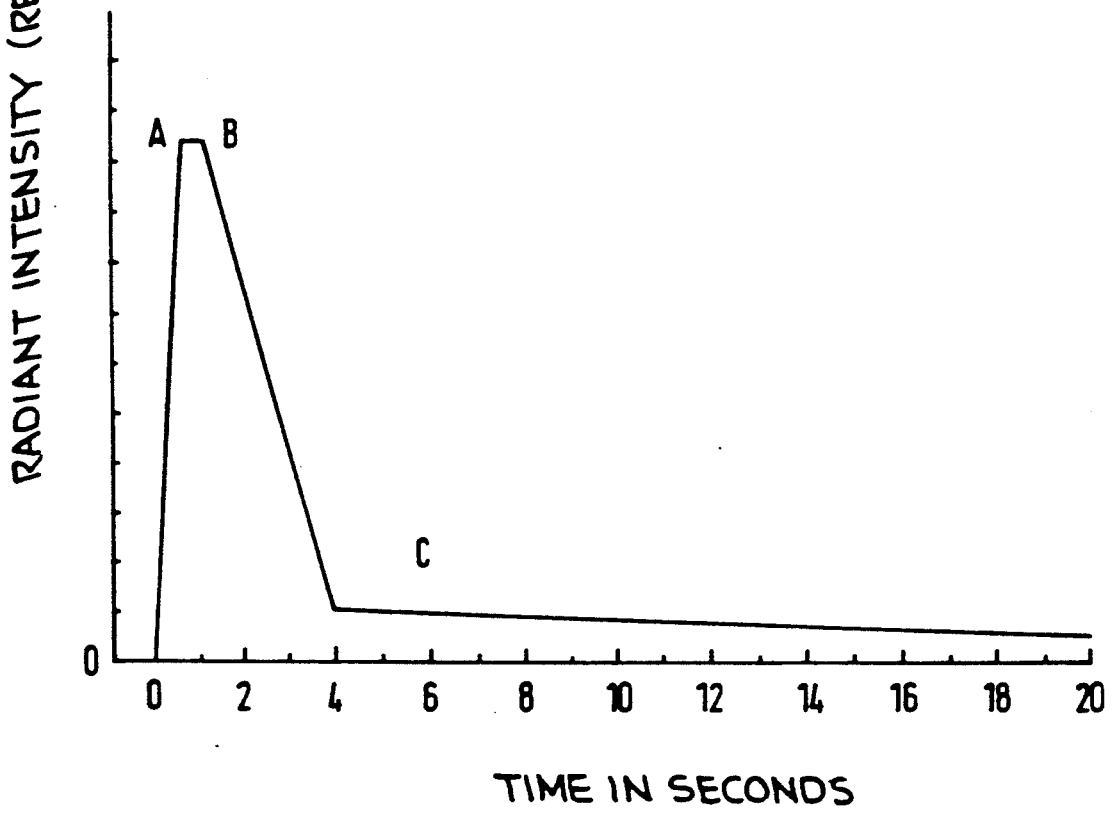
FIG. 3 is a graph of the radiant intensity curve for a perturbing radiation cloud according to the invention.

The radiation of the perturbing radiation cloud is to run its course as shown in FIG. 3. Described more precisely, the radiant intensity is to increase very rapidly to a high value, in order to obtain an effect that is as delay free as possible, namely to the effect that interferences of the ship signature are induced in the infrared seeker head, the result of which is the loss of a target. Similarly the radiant intensity is supposed to drop very rapidly to a comparatively low value, in order to avoid persistent attraction of the seeker head. The phase of strong radiation is to have a duration of two to four seconds maximum. Following this phase of high radiant intensity is then a phase of comparatively low radiant intensity, for which a period of at least 15 seconds must be set. This phase of low radiant intensity serves to provide a persistent modification of the ship signature. This modification is induced by damping and irradiation effects of the active substance that varies in time and space.

The aforementioned radiant intensity characteristic can be achieved with droppable bodies, whose active mass is a mixture of the following components:

| | |
|---|---|
| small area phosphorus flares: | approx. 50% |
| large area phosphorus flares: | approx. 10% |
| phosphorus pellets: | approx. 40% |

The relevant wavelength ranges can be optimized with radiometric measurements.

Figure 4:
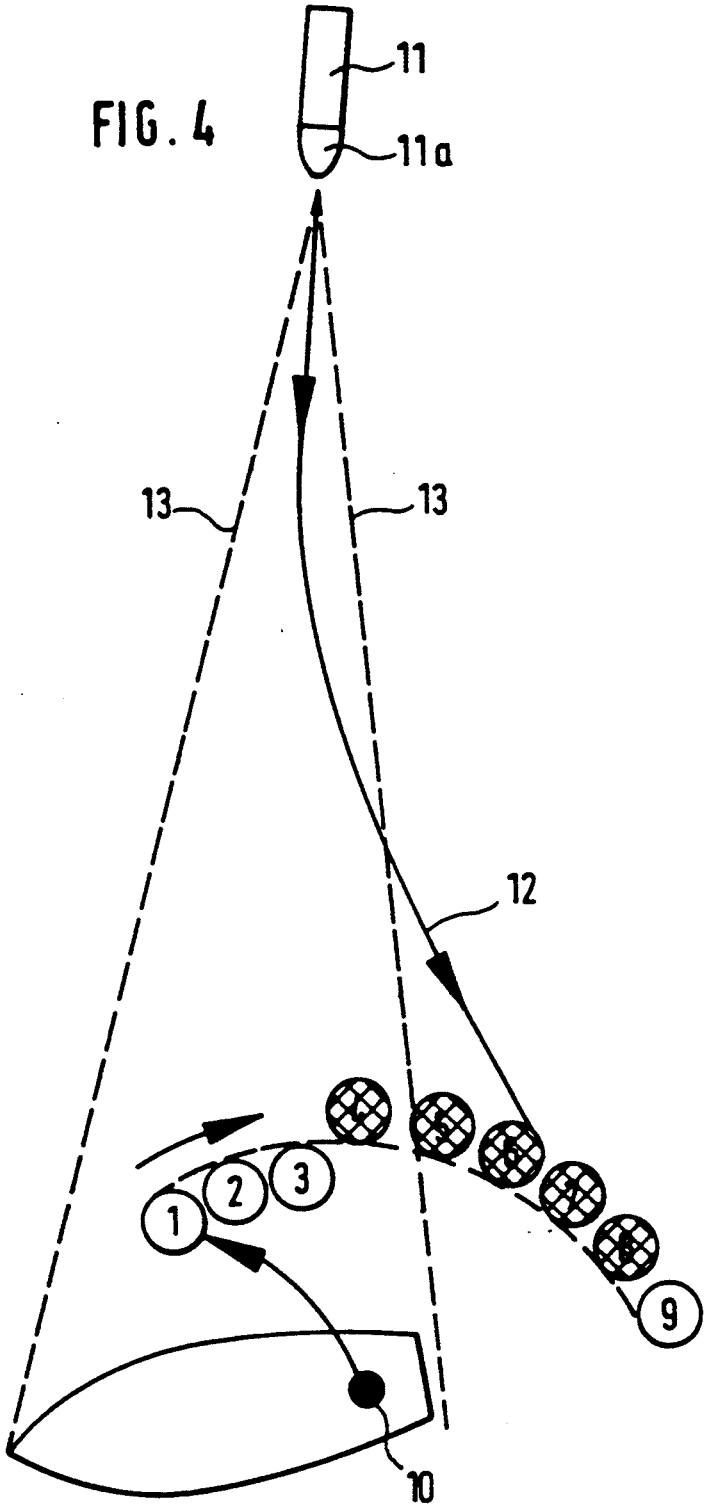
FIG. 4 is a schematic illustration of the deflection of an approaching missile with intelligent seeker head.

The method of deflecting an approaching missile is now explained with reference to FIG. 4. In FIG. 4 the ship to be defended is denoted as 10; the missile, which is approaching the ship and is equipped with an intelligent infrared seeker head 11*a*, is denoted as 11. 12 denotes the flight path of the missile 11; and the dashed lines 13 correspond to the limit of the viewing window of the seeker head 11*a* already locked on the ship 10, thus the window B of FIG. 1. As soon as the ship 10 detects the approach of the missile 11, its distance from the ship and its speed are determined. As a function of these values, the ship fires now at short intervals, for example, at intervals of one second, three droppable bodies, which then generate perturbing radiation clouds at points 1, 2, and 3 of FIG. 4, thus at points, which lie side by side between ship 10 and missile 11 and cover substantially the region between the limits 13. The droppable bodies release their active mass at ship height, thus at a height of about 30 meters, and in particular while igniting the active mass. By means of the three perturbing radiation clouds 1, 2, 3 interference signals are induced in the electronic seeker head components—the "target reference detector", the "gate generator" and/or the correlation computer—in the aforementioned first radiation phase, a condition that leads to the destruction of the ship signature, in other words to the seeker head losing the target.

Immediately upon setting up the last perturbing radiation cloud, the first fake target cloud 4 is brought out, and in particular in the outer region of the window of sight of the seeker head 11*a* defined by the dashed line 13. The fake target cloud 4 also generated in the conventional manner by a droppable body shot from the ship 10 shall have a large area and exhibit high radiant intensity in all relevant wavelength ranges.

A radiating, horizontal, ship-like "hose", whose radiation point of concentration wanders outwardly continuously (from 4 to 9), is formed in the projection of the seeker head by means of other fake target clouds 5, 6, 7, 8 and 9, set up at intervals of 4 seconds, for example.

The seeker head 11*a* will follow the outwardly wandering radiation point of concentration of the fake target clouds, since with respect to radiant intensity and area such clouds represent a significantly more attactive target than the ship 10, especially since its infrared signature is persistently erased owing to the camouflage effect of the perturbing radiation clouds 1, 2, 3 or can no longer be distinguished from the background radiation.

Thus, the approaching missile 11 is guided always further from the ship 10.

The fake target clouds 4 to 9 are supplied, as aforementioned, with conventional active masses, which comprise in general phosphorus flares. The height of the flare disintegration shall be at the upper edge of window B, thus at ship height. If the height is 30 meters and the speed of descent is 2.5 m/s, the result is a flare persistency of 12 seconds. Such a duration of effect in connection with the aforementioned 4 seconds to produce clouds 4 to 9, the large area dimension of the clouds and the preference for a radiation frequency adapted to the ship radiation leads to an optimal deflection of the seeker head and thus the missile.

As apparent from FIG. 4, the perturbing radiation clouds 1 to 3 and the fake target clouds 4 to 9 lines substantially on a sector around a center point, which is located on the ship 10. This has the advantage that all of the droppable bodies generating the clouds 1 to 9 can be fired in succession from a single firing platform, whereby it is only necessary to swivel the platform step-by-step. In so doing, a vertical adjustment of the platform is not necessary during this swivelling movement, unless the ship 10 is undergoing strong movements (heavy seas) during the firing operation. Another significant advantage of the explained setting up of fake target clouds 4 to 9 on a partial circle is that from the perspective of the missile a related "fake target band" is produced, and in particular with the formation of a radiation point of concentration at the point furthest away from the ship.

Furthermore, a fast employment of the droppable bodies optimally tuned to the direction of danger is assured with the aid of the circular output process, and in particular with a deflection direction always at right angles to the direction of danger.

It is not necessary that all fake target clouds 4 to 9 be infrared fake targets, rather a combination of infrared fake target clouds, such as clouds made of phosphorus flares, and RF clouds, such as clouds made of metal strips, is expedient, in order to be able to correspondingly interfere or divert seeker heads with radar guidance.

Of course, the invention is not restricted to the embodiment shown, rather numerous variations are possible within the scope of the invention. This applies to the number of perturbing radiation and fake target clouds to be set up, their time and spatial intervals, the composition of their active masses, the type of droppable bodies and the number and movement of the firing barrels (ejectors). In addition, there are many possibilities for controlling the ejectors based on preprogrammed or threat-dependent computer systems. In any event, however, it must be assured that first the ship signature is destroyed, because a deflection operation cannot be initiated until then.

What is claimed is:

1. Process to defend objects emitting an infrared radiation against missiles, which are equipped with scanning, imaging, correlating or spectral filtering infrared seeker heads, comprising the following process steps to be carried out by the object to be defended:

a) locating the missile; and determining the missile speed, the missile flight direction and the missile momentary distance from the object;

b) releasing in a short period of time high infrared radiation near the object at least one large area and homogeneous pyrotechnical perturbing radiation cloud, which prevents the reception of the characteristic infrared signature of the object by means of the seeker head and hashes its locking on and pursuit electronics, and subsequently releasing for a comparatively long period a weak, transmission-reducing infrared radiation that simulates background radiation between said object and the missile;

c) starting immediately after termination of the high radiation phase of the perturbing radiation cloud, but at least still during its weak radiation phase, several successive large area and homogeneous pyrotechnical infrared fake target clouds that resemble the infrared signature of the object are produced, at least the fake target clouds being produced on a partial circle, whose center point is on the object to be defended, and starting from a point in the vicinity of the perturbing radiation cloud, side by side continuously in such a manner that they lead the seeker head and thus the missile step by step substantially diagonally to the approach direction away from the object.

2. Process, as claimed in claim 1, wherein at short intervals several large area perturbing radiation clouds are set up side by side between the object to be defended and the missile.

3. Process, as claimed in claim 2, wherein the intervals are approximately one second.

4. Process, as claimed in claim 1, wherein the fake target clouds are set up at intervals of 2 to 10 seconds.

5. Process, as claimed in claim 1, wherein the phase of high infrared radiation of the perturbing radiation cloud is two seconds; the phase of the subsequent weak radiation and transmission reduction is at least 10 seconds.

6. Process, as claimed in claim 1, wherein radar fake target clouds are set up in addition to the infrared fake target clouds.

7. Process, as claimed in claim 1, wherein the partial circle of fake target clouds is a quarter circle.

* * * * *